US008764421B2

(12) United States Patent
Ke et al.

(10) Patent No.: US 8,764,421 B2
(45) Date of Patent: Jul. 1, 2014

(54) SCROLL TYPE FLUID MACHINERY

(75) Inventors: Enjiu Ke, Nanchang (CN); Ji Ke, Windsor (CA)

(73) Assignee: Shanghai Universoon AutoParts Co., Shanghai (CN)

( * ) Notice: Subject to any disclaimer, the term of this patent is extended or adjusted under 35 U.S.C. 154(b) by 699 days.

(21) Appl. No.: 12/742,085

(22) PCT Filed: Nov. 6, 2008

(86) PCT No.: PCT/IB2008/054624

§ 371 (c)(1), (2), (4) Date: Aug. 2, 2010

(87) PCT Pub. No.: WO2009/060398

PCT Pub. Date: May 14, 2009

(65) Prior Publication Data

US 2010/0284846 A1 Nov. 11, 2010

(30) Foreign Application Priority Data

Nov. 8, 2007 (CN) ..... 2007 1 0009788

(51) Int. Cl.

*F01C 1/02* (2006.01)
*F01C 1/063* (2006.01)
*F03C 2/00* (2006.01)

(52) U.S. Cl.

USPC ..... 418/55.3; 418/55.1; 418/55.2; 418/5; 418/7; 418/209; 418/210; 418/215

(58) Field of Classification Search

USPC ..... 29/888.022; 418/1, 60, 150, 5, 7, 418/55.1–55.6, 57, 209, 210, 215, 270; 464/102

See application file for complete search history.

(56) References Cited

U.S. PATENT DOCUMENTS 801,182 A 10/1905 Creux
3,011,694 A 12/1961 Audemar (Continued)

FOREIGN PATENT DOCUMENTS

CN 1711408 A 12/2005
CN 1963205 A 5/2007

(Continued)

OTHER PUBLICATIONS

Machine Translation Description DE 195 28 070.*

(Continued)

*Primary Examiner* — Thomas Denion
*Assistant Examiner* — Jason T Newton
(74) *Attorney, Agent, or Firm* — Song Zhu; Hogan Lovells US LLP

(57) ABSTRACT

Scroll type fluid machinery, in which two stationary scrolls (2A, 2B) are fixed onto a housing (1), and form volume changing mechanisms (50A, 50B) with matching orbiting scrolls (3A, 3B). Three orbiting units (40) are located between the two volume changing mechanisms. Each orbiting unit comprises a rotating member (10) and a thrust-cancelling shaft (20). Assembly sets of the thrust-canceling shaft consist of turning elements and a connector, which in turn connects with orbiting scrolls through threads. There exists only circumferential constraint but no axial constraint between the connector and the turning element. Rotating turning element will rotate the connector, and thus move the two orbiting scrolls closer or farther through the threads on the connector. The rotating member of this invention further provides a larger space to the supporting bearings (14A, 14B) of the thrust-canceling shaft, and also eases component manufacturing, machinery's assembly and adjustment, and bearings' cooling.

18 Claims, 19 Drawing Sheets

(56) References Cited

U.S. PATENT DOCUMENTS

| | | | | | |
|---|---|---|---|---|---|
| 3,802,809 | A | * | 4/1974 | Vulliez | 418/5 |
| 4,424,010 | A | | 1/1984 | McCullough | |
| 4,515,539 | A | | 5/1985 | Morishita | |
| 4,553,913 | A | | 11/1985 | Morishita et al. | |
| 4,604,039 | A | * | 8/1986 | Terauchi | 418/55.1 |
| 4,990,071 | A | * | 2/1991 | Sugimoto | 418/55.2 |
| 5,304,047 | A | | 4/1994 | Shibamoto | |
| 5,624,243 | A | * | 4/1997 | Omodaka et al. | 417/366 |
| 5,690,480 | A | | 11/1997 | Suzuki et al. | |
| 5,755,564 | A | | 5/1998 | Machida et al. | |
| 5,775,893 | A | | 7/1998 | Takao et al. | |
| 6,123,529 | A | * | 9/2000 | Kawano et al. | 418/55.2 |
| 6,149,405 | A | * | 11/2000 | Abe et al. | 417/420 |
| 6,267,572 | B1 | * | 7/2001 | Suefuji et al. | 418/5 |
| 6,379,134 | B2 | * | 4/2002 | Iizuka | 418/55.2 |
| 6,450,791 | B1 | | 9/2002 | Kawabata et al. | |
| 6,464,467 | B2 | * | 10/2002 | Sullivan et al. | 417/53 |
| 6,988,876 | B2 | | 1/2006 | Ke et al. | |
| 7,201,568 | B2 | * | 4/2007 | Sakamoto et al. | 418/60 |
| 2004/0086407 | A1 | * | 5/2004 | Ke | 418/55.2 |
| 2004/0219047 | A1 | * | 11/2004 | Ke et al. | 418/55.1 |
| 2007/0231175 | A1 | | 10/2007 | Suefuji et al. | |
| 2010/0284846 | A1 | * | 11/2010 | Ke et al. | 418/60 |

FOREIGN PATENT DOCUMENTS

| | | | |
|---|---|---|---|
| DE | 19528070 | A1 | 2/1997 |
| EP | 0846843 | A1 | 6/1998 |
| EP | 1101943 | A2 | 5/2001 |
| JP | 57000303 | A | 1/1982 |
| JP | 57000304 | A | 1/1982 |
| JP | 60053601 | | 3/1985 |
| JP | 04121474 | A | 4/1992 |
| JP | 05052189 | | 3/1993 |
| JP | 05141367 | A | 6/1993 |
| JP | 200298070 | A | 4/2002 |
| JP | 2002174186 | | 6/2002 |
| JP | 2002257064 | A | 9/2002 |
| JP | 2003201978 | A | 7/2003 |
| JP | 2003293966 | A | 10/2003 |
| JP | 2004116471 | A | 4/2004 |
| JP | 2004263604 | A | 9/2004 |
| JP | 2006152961 | A | 6/2006 |
| JP | 2006336507 | A | 12/2006 |
| WO | 03083524 | A1 | 10/2003 |
| WO | 2005045249 | A1 | 5/2005 |

OTHER PUBLICATIONS

Machine Translation Description JP 2002-098070.*
Machine Translation Description JP 2004-263604.*
Machine Translation Description JP 2004-116471.*
Machine Translation Description JP 2006-336507.*
Machine Translation Description JP 2003-293966.*
Machine Translation Description JP 2002-257064.*
Machine Translation Description JP 2006-152961.*
Machine Translation Description JP 2003-210978.*
Written Opinion of the International Searching Authority, mailing date Apr. 2, 2009, International Application No. PCT/IB2008/054624, 3 pgs.
International Search Report, International Application No. PCT/IB2008/054624, mailing date, Apr. 2, 2009, 3 pgs. 11.

* cited by examiner

SCROLL TYPE FLUID MACHINERY

BACKGROUND OF THE INVENTION

The present invention relates to scroll type fluid machinery, which can be used as compressors, vacuum pumps, expander machines, etc.

Double-scroll fluid machinery has got people's attentions due to its many advantages such as thrust force canceling. The technology of Double-Scroll linked by a Plurality of Orbiting units (DSPO) revealed in US patent U.S. Pat. No. 6,988,876 has two volume changing mechanisms, each of which comprises its respective orbiting scroll and stationary scroll. The two stationary scrolls are connected with a housing. Orbiting units are located between the two volume changing mechanisms. Each orbiting unit comprises a rotating member that is rotatably supported on the housing, and a thrust-canceling shaft that is eccentrically and rotatably supported in the rotating member. The thrust-canceling shaft connects the two orbiting scrolls with its two ends to form a frame structure. The orbiting scrolls orbit with respect to the matching stationary scrolls when the rotating members are driven, and thus the continuous changes of the volumes are realized.

It has been revealed in Chinese Patent Publication CN1963205A that DSPO can easily realize internal fluid injection cooling (especially water injection), because the volume changing mechanisms and the orbiting units are separated by the decompression chambers, and the bearings are not installed directly on the orbiting scrolls.

Due to the engagement between DSPO's orbiting scrolls and the respective stationary scrolls, the two orbiting scrolls are required to connect with the thrust-canceling shaft accurately in both radial and axial directions. However, it is not practical to have through holes on the end plates of the orbiting scrolls for installing and tightening the thrust-canceling shaft, since one side of the end plate is a working surface of the compressing chamber. Therefore, the installation and adjustment of the thrust-canceling shaft into the orbiting scrolls are pretty tough.

DSPO's orbiting units have two bearing groups, the thrust-canceling shaft supporting bearing group, and the rotating member supporting group. The former is installed inside with a very small space, though it withstands a larger load. The current DSPO technology still has issues in resolving the heat dissipating, and the adjustment of the axial clearance and the pre-load of the bearing group supporting the rotating member. These issues limit the utilization of DSPO technology for the fluid machinery with a large capacity.

SUMMARY OF THE INVENTION

An object of the present invention is, by improving the structure design of DSPO orbiting units, to improve the assembly and the adjustment processes of the scroll type fluid machinery with orbiting units, and thus to improve the reliability and durability of the machine, reduce the manufacturing cost, and improve the cooling of the bearings, which make it possible for DSPO technology to be utilized for the fluid machinery with a larger capacity.

These improvements include the utilization of the assembled rotating members, the assembly sets of the thrust-canceling shaft, the bearing cooling structure, the load balancing device and method of rotating members, and the bearing pre-tightening and adjusting device.

According to one aspect of the present invention, the thrust-canceling shaft contains the assembly sets for the installation of orbiting scrolls. The assembly set has a connector connecting directly or indirectly with the orbiting scrolls through threads, and a turning element that directly or indirectly constrains the connector circumferentially but allows the connector to move axially. When the turning element is rotated during the assembly, the connector is turned accordingly, and thus the two orbiting scrolls can be pulled closer and tight through the threads. Therefore, the outer portion of the thrust-canceling shaft is compressed but the connector is stretched, which can result in adequate assembly stress for sound connections. To prevent from loosening, the tightening direction should be opposite to the rotation direction of the rotating members for the fluid energizing machinery, such as compressors, vacuum pumps, etc. The locking device can also be used for this purpose. Meanwhile, the turning element can be rotated in the opposite direction to disassemble the orbiting scrolls.

The thrust-canceling shaft can have multiple assembly sets, and the connector can have a thread on one end, two threads with opposite directions on the two ends, or two threads with the same direction but different pitches on the two ends. The number of the assembly sets, the different options of the connector threads and the turning elements make up different forms of thrust-canceling shafts. The connector and the turning element not only form the assembly set and realize the pre-load and the assembly of orbiting scrolls and the thrust-canceling shaft, but also have other functions. For example, the turning element can be used to adjust the axial position of the orbiting scrolls, and serves as the sealing washer of the bearing. The connector can also directly fit into the inner ring of the bearing group supporting the thrust-canceling shaft to take the radial load from the bearing group.

The assembled rotating member provided in the present invention comprises 1) a rotator with an eccentric hole to hold the bearing group supporting the thrust-canceling shaft, and 2) two rotating hubs on which the supporting bearings of the rotating member are installed. The two rotating hubs are assembled together with the rotator to ensure a co-axle for the two bearings on the rotating hubs. The supporting bearing group of the thrust-canceling shaft can take a larger space, because of the fact that the bearings are located at different axial positions, which also benefits the manufacturing of the components, and the assembling and the adjustment of the bearings. There are air cooling holes and ducts on the rotator and the rotating hubs. The centrifugal force makes the air to flow around to cool the rotating members and the bearings when the machinery operates. The rotator can be an assembly of separate pieces and comprises: a) an eccentric ring, which is assembled with the two rotating hubs, and b) an outer driving ring, which can have the form of gear, sprocket, or synchronizing pulley, etc., the driving ring is fitted onto the eccentric ring, and can have elastic connections with the rotating hubs in the circumferential direction. This can make the load more evenly distributed among the orbiting units. Considering the relatively long length of the thrust-canceling shaft, a bearing support can be installed between the thrust-canceling shaft and the rotating hubs. Furthermore, the rotator and a rotating hub can be integrated into one component.

The present invention also provides cooling water ducts, cooling blades on rotating members, isolating plates for cooling air disturbance prevention, and the axial clearance adjustment device for the supporting bearings of the rotating members.

The present invention further provides the method to adjust the wrapping angles of the flexible driving element on the rotating members, in order to minimize the difference of the loads among rotating members.

The advantages of the present invention include the increased space for the supporting bearings of the thrust-canceling shaft due to the improvement of the DSPO orbiting unit structures, and the improvement of assembly and adjustment processes of the DSPO machinery. Thus the reliability and the durability of the machinery are improved, the manufacturing cost is reduced, the load difference on different bearings is minimized, and the bearings are cooled more efficiently. Thus the manufacturing of the DSPO machine models of larger capacities becomes possible.

DETAILED DESCRIPTION OF INVENTION

Embodiment 1

Water-Injection Oil-Free Scroll Air Compressors

As shown in FIGS. 1-4, according to the present invention, this embodiment comprises volume changing mechanisms 50A and 50B consisting of orbiting scrolls 3A and 3B and respective stationary scrolls 2A and 2B. Stationary scrolls 2A and 2B are connected with a housing 1, and three orbiting units 40 are arranged between volume changing mechanisms 50A and 50B. Each orbiting unit comprises an assembled rotating member 10, which is supported on housing 1 through bearings 11A and 11B, a thrust-canceling shaft 20, which is supported eccentrically in rotating member 10 through bearings 14A and 14B. The two ends of thrust-canceling shaft 20 connect with orbiting scrolls 3A and 3B. The outer rings of the three rotating members are pulleys. When rotating member 10 is driven, orbiting scrolls 3A and 3B make orbiting motion while engaging with stationary scrolls 2A and 2B to continuously change the volumes formed between orbiting scrolls 3A, 3B and stationary scrolls 2A, 2B. Air enters volume changing mechanisms 50A and 50B through inlets 4A and 4B, and is discharged from outlets 5A and 5B after the air is compressed. Water is injected into volume changing mechanisms 50A and 50B through-hole sets 27A and 27B or inlets 4A and 4B to provide functions of sealing, lubricating, and cooling.

Figure 1:
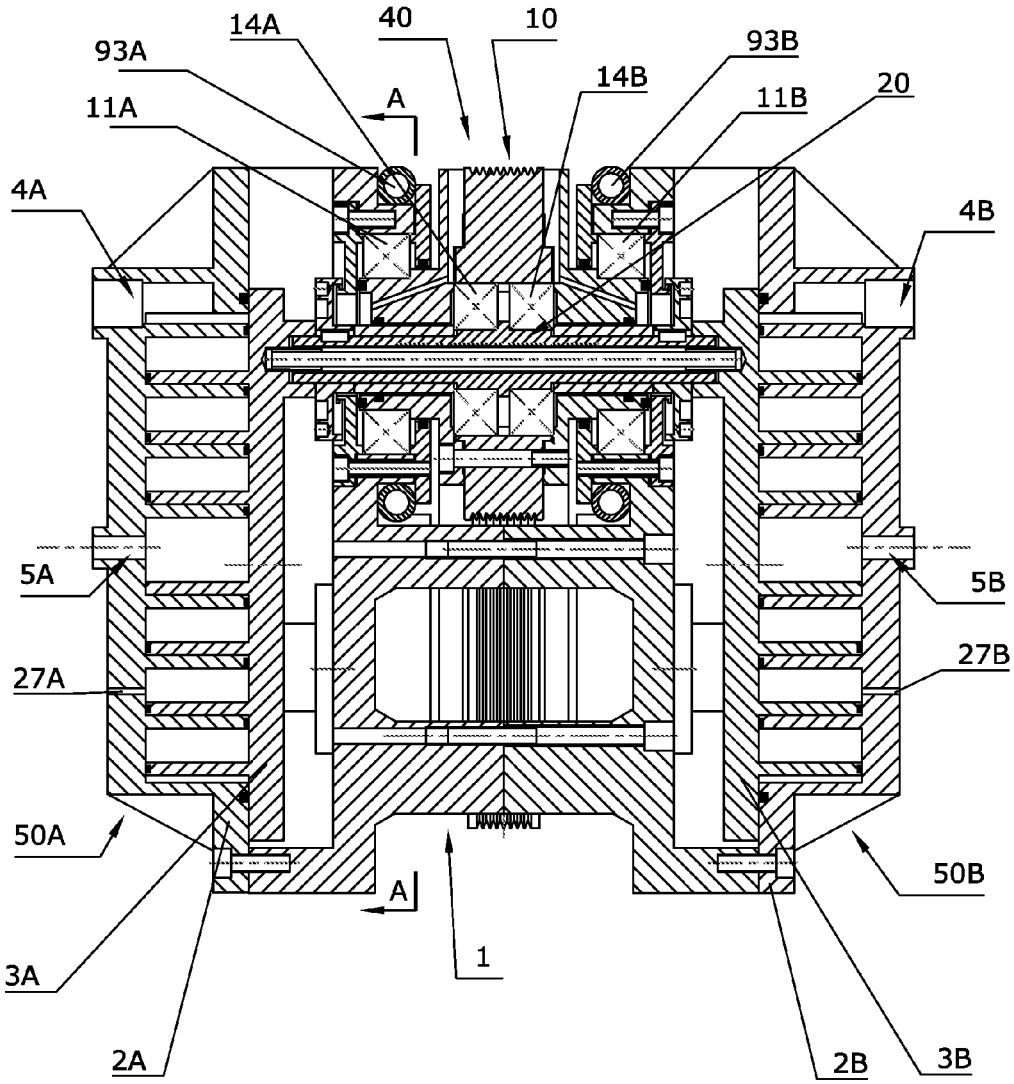
FIG. 1 is a schematic sectional view of a water-injection oil-free scroll air compressor according to embodiment 1 of the present invention.
Figure 2:
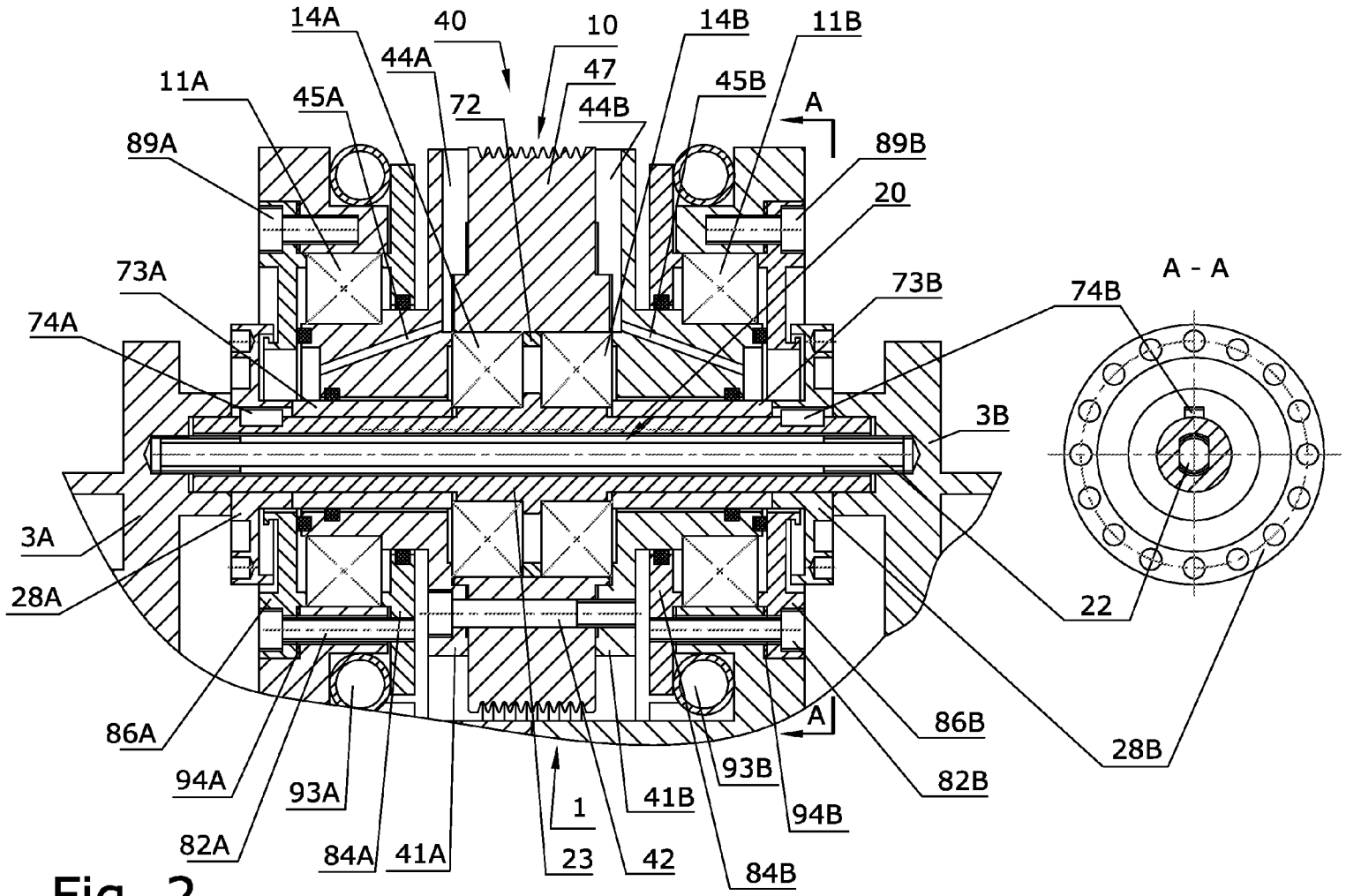
FIG. 2 is an enlarged schematic view of an orbiting unit of the machinery shown in FIG. 1.
Figure 3:
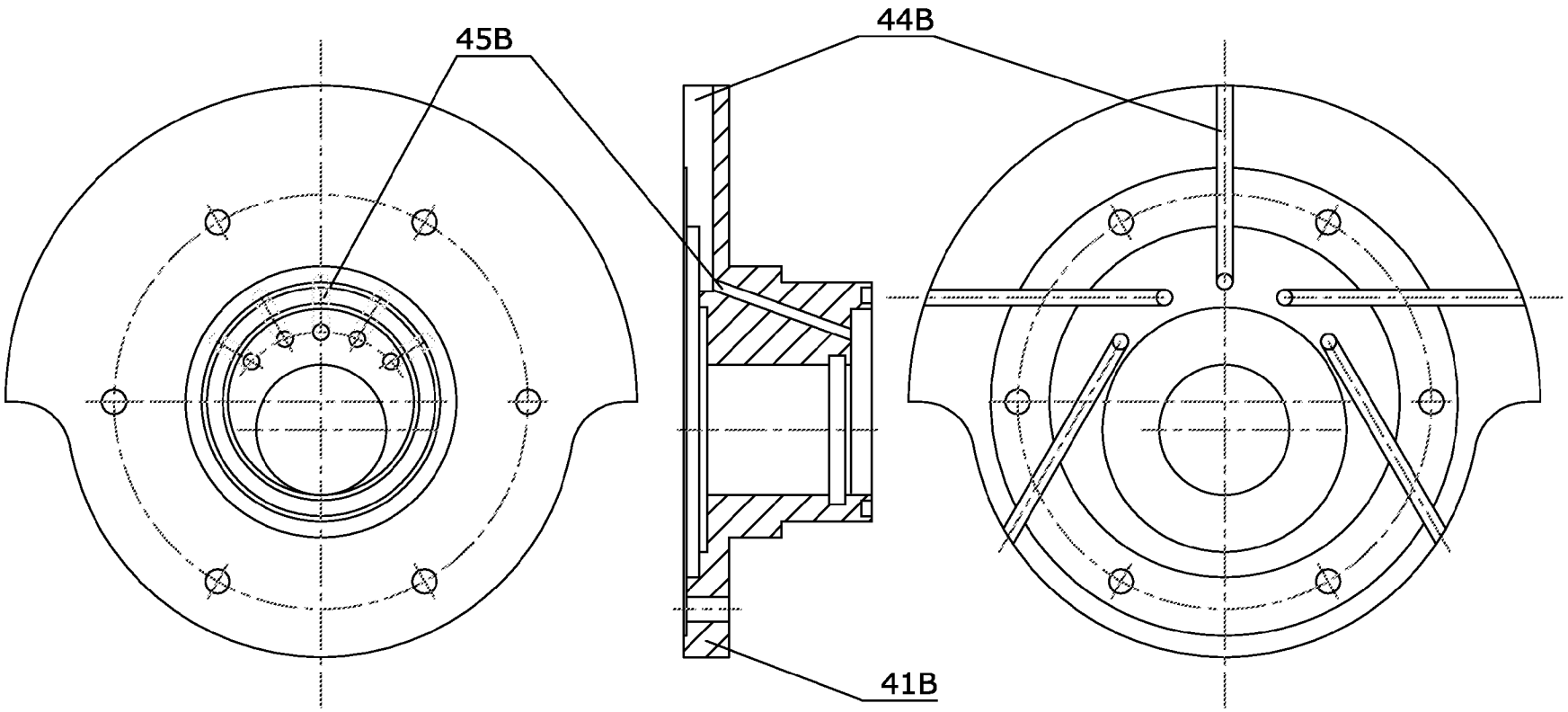
FIG. 3 is a schematic view of a rotating hub of the machinery shown in FIG. 1.
Figure 4:
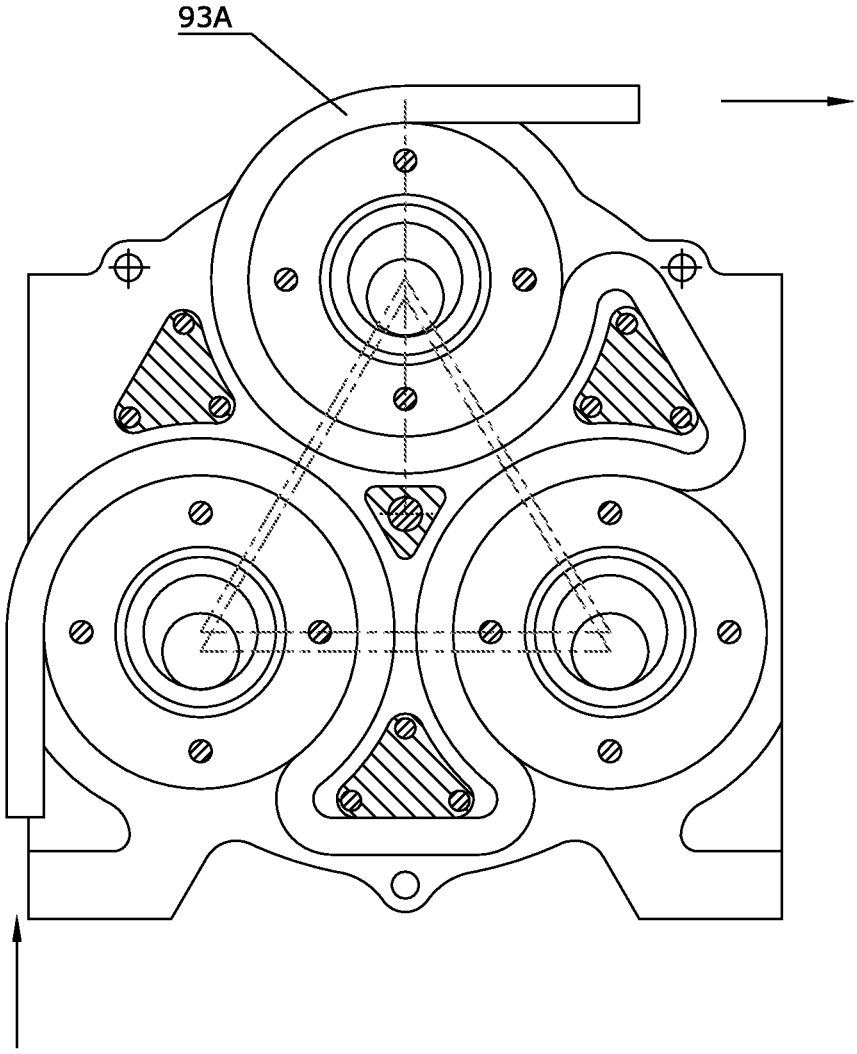
FIG. 4 is the layout view of the cooling water ducts of the machinery shown in FIG. 1.

The assembled rotating member 10 comprises a rotating ring 47 and rotating hubs 41A and 41B. Rotating ring 47 and rotating hubs 41A, 41B are fastened together by screw set 42. The inner rings of bearings 11A and 11B are located on rotating hubs 41A and 41B, and the outer rings of bearing 14A and 14B are located in the eccentric hole of rotating ring 47. There are also centrifugally cooling air ducts 44A, 44B, 45A, and 45B in rotating hubs 41A and 41B, as shown in FIG. 3. End covers 86A, 84A, 86B, and 84B of bearings 11A and 11B are fixed on housing 1 through screw sets 89A, 82A, 89B, and 82B. Compensating shims 94A and 94B are used to adjust the axial gaps of bearings 11A and 11B. Cooling water ducts 93A and 93B wind around bearings 11A and 11B on housing 1 with heat conducting materials filling in the gaps between housing 1 and ducts 93A and 93B. FIG. 4 is the layout plan of cooling water duct 93A.

Thrust-canceling shaft 20 has an assembly set comprising a screw rod 22 (as connector) and retaining rings 28A and 28B (as turning elements). Screw rod 22 has threads with opposite direction on its two ends, which engage with the thread holes on orbiting scrolls 3A and 3B, respectively. Screw rod 22 has two flat surfaces, and fits into the hole in shaft 23 with the similar shape, as shown in view A-A of FIG. 2. Retaining rings 28A and 28B (or turning elements) constrains screw rod 22 (or connector) circumferentially while allowing it to move freely in the axial direction. Retaining rings 28A and 28B can rotate shaft 23 through keys 74A and 74B, and so rotate screw rod 22. The two ends of the screw rod 22 screw into and pulls tightly orbiting scrolls 3A and 3B. With the pulling effect of screw rod 22, the outer portion of thrust-canceling shaft 20, sleeves 73A and 73B, retaining rings 28A and 28B, and the middle shoulder of shaft 23 are compressed, and thus appropriate assembly stress is obtained. When disassembling the machine, retaining rings 28A and 28B are turned in the other direction, which results in pushing the orbiting scrolls 3A and 3B apart through the threads at the two ends of screw rod 22.

Five different thrust-canceling shaft structures are provided in the following embodiments 2-6. The same constituent elements as those in the embodiment 1 are denoted by the same reference numerals in FIGS. 5-9, and a description thereof is omitted.

Embodiment 2

Figure 5:
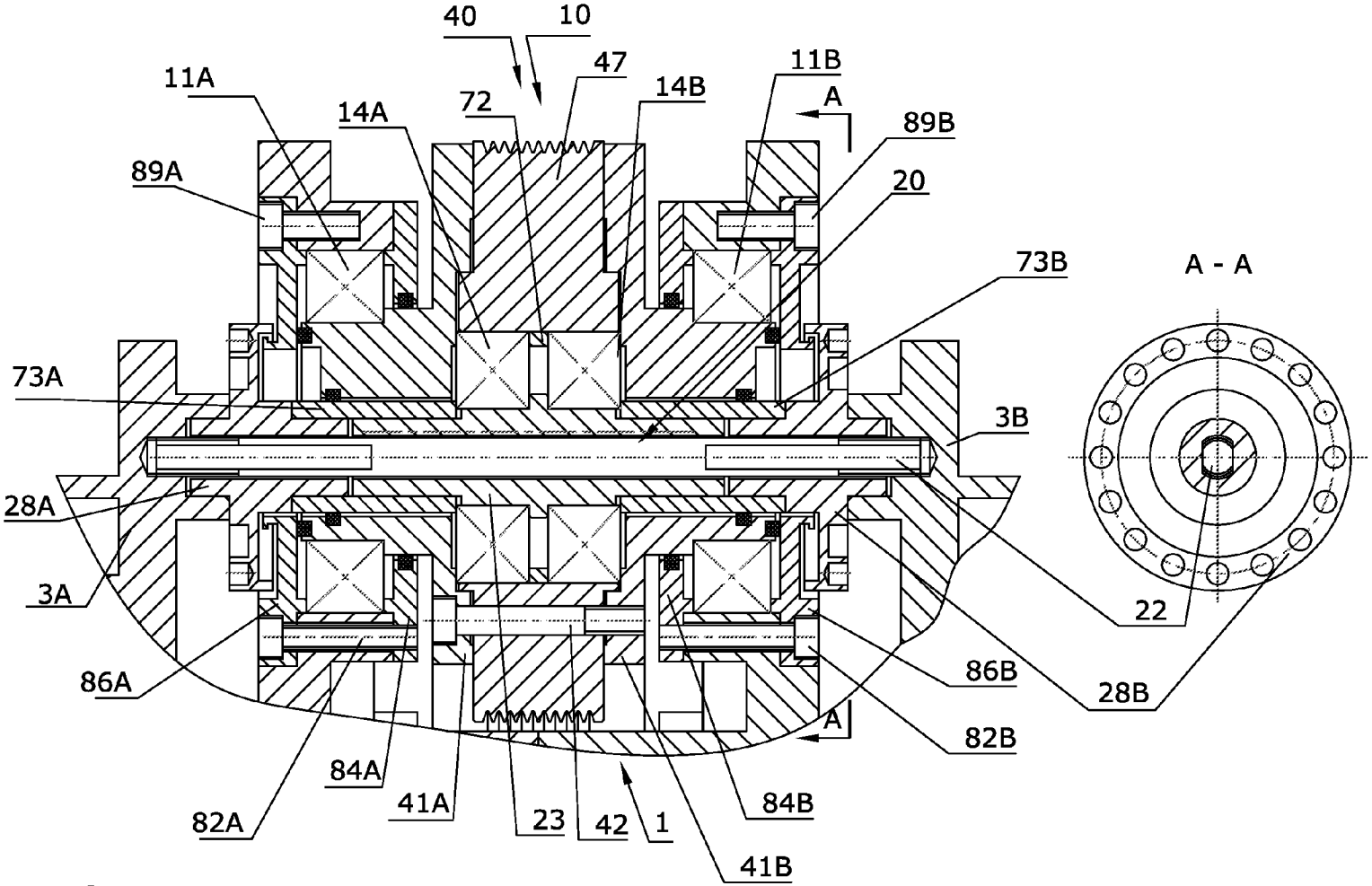
FIG. 5 is a schematic sectional view of an orbiting unit of the machinery according to embodiment 2 of the present invention.

As shown in FIG. 5, retaining rings 28A and 28B (turning elements) replace portions of shaft 23 and connect orbiting scrolls 3A and 3B. Only the two ends of screw rod 22 (connector) are made to have two flat surfaces, fitting into the similar shape holes in retaining rings 28A and 28B. Thus there exists circumferential constraint between the retaining rings 28A, 28B and screw rod 22, but no axial constraint between them, as shown in view A-A of FIG. 5. Retaining rings 28A and 28B can then rotate screw rod 22 to assemble or disassemble orbiting scrolls 3A and 3B.

In the above embodiments 1 and 2, only one retaining ring, 28A or 28B, is needed to assemble or disassemble orbiting scrolls 3A and 3B. In these cases, the constituent elements forming the circumferential constraint, such as the key or the flat surfaces, can be eliminated at one end.

Embodiment 3

Figure 6:
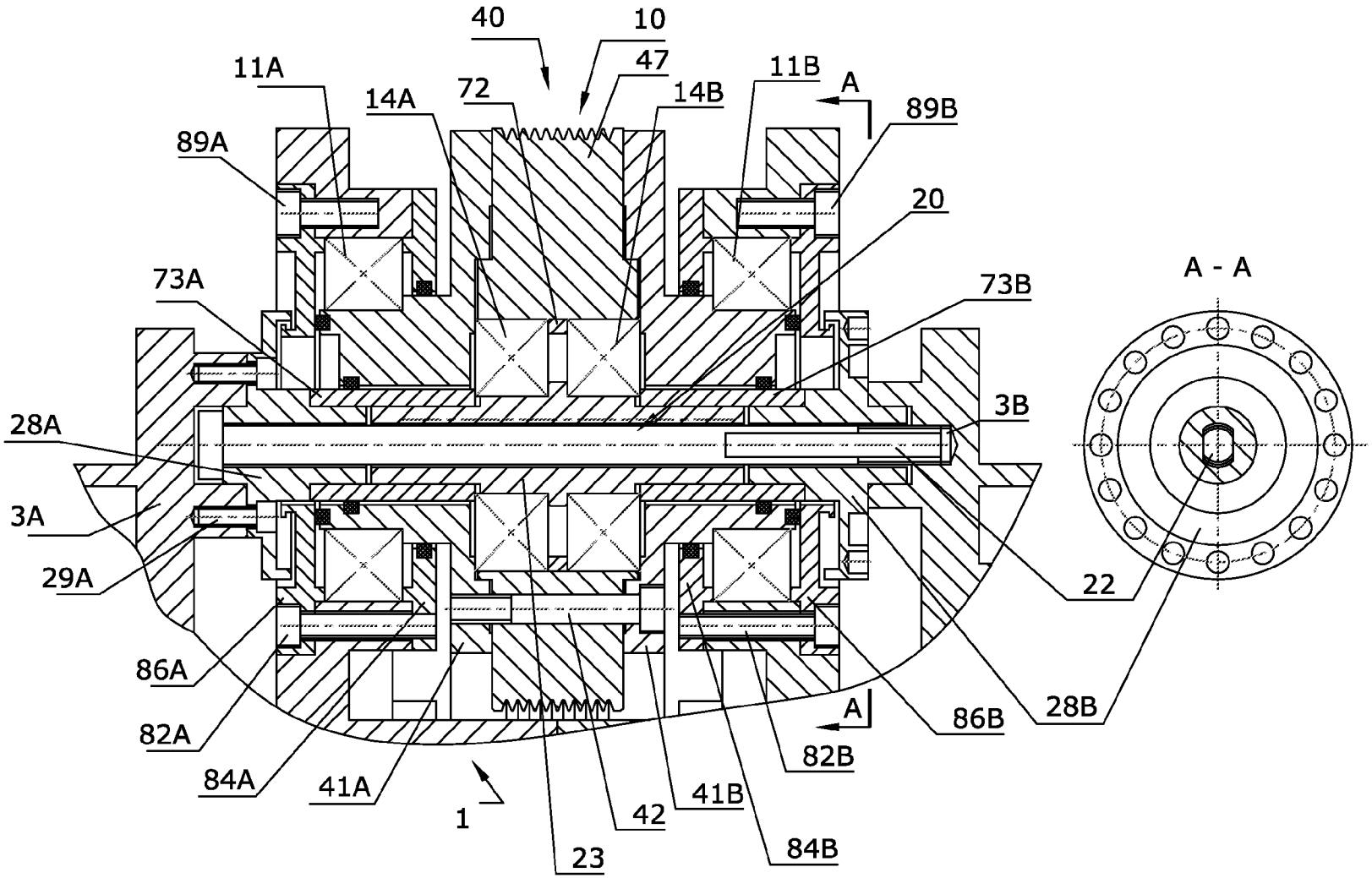
FIG. 6 is a schematic sectional view of an orbiting unit of the machinery according to embodiment 3 of the present invention.

As shown in FIG. 6, the right end of screw rod 22 (connector) is connected with orbiting scroll 3B through thread, but its left end is made to a form of round head. The left retaining ring 28A is fixed onto orbiting scroll 3A by screw set 29A. There is a slot hole in retaining ring 28B (turning element) to form only circumferential constraint to screw rod 22, as shown in view A-A of FIG. 6. Retaining ring 28B can directly rotate screw rod 22 to assemble or disassemble orbiting scrolls 3A and 3B.

Embodiment 4

Figure 7:
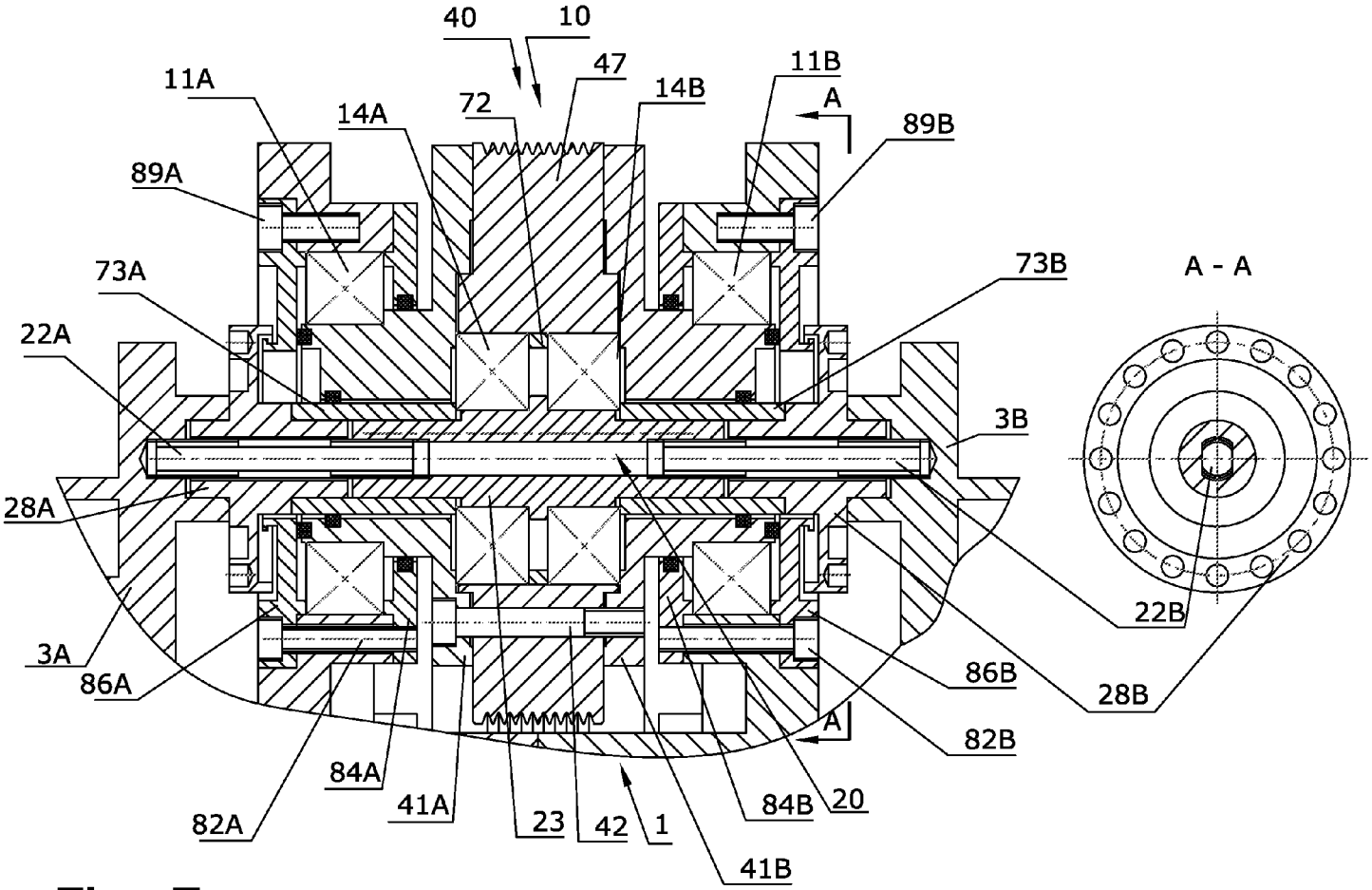
FIG. 7 is a schematic sectional view of an orbiting unit of the machinery according to embodiment 4 of the present invention.

As shown in FIG. 7, comparing with embodiment 2, the differences of this embodiment include that thrust-canceling shaft 20 has two independent assembly sets. Screw rods 22A and 22B (connectors) are made to have two flat surfaces and opposite direction threads at their two ends on each rod, and they are connected with orbiting scrolls 3A and 3B and shaft 23 accordingly. Retaining rings 28A and 28B (turning elements) can then rotate the screw rods 22A and 22B to assemble or disassemble orbiting scrolls 3A and 3B separately.

Embodiment 5

Figure 8:
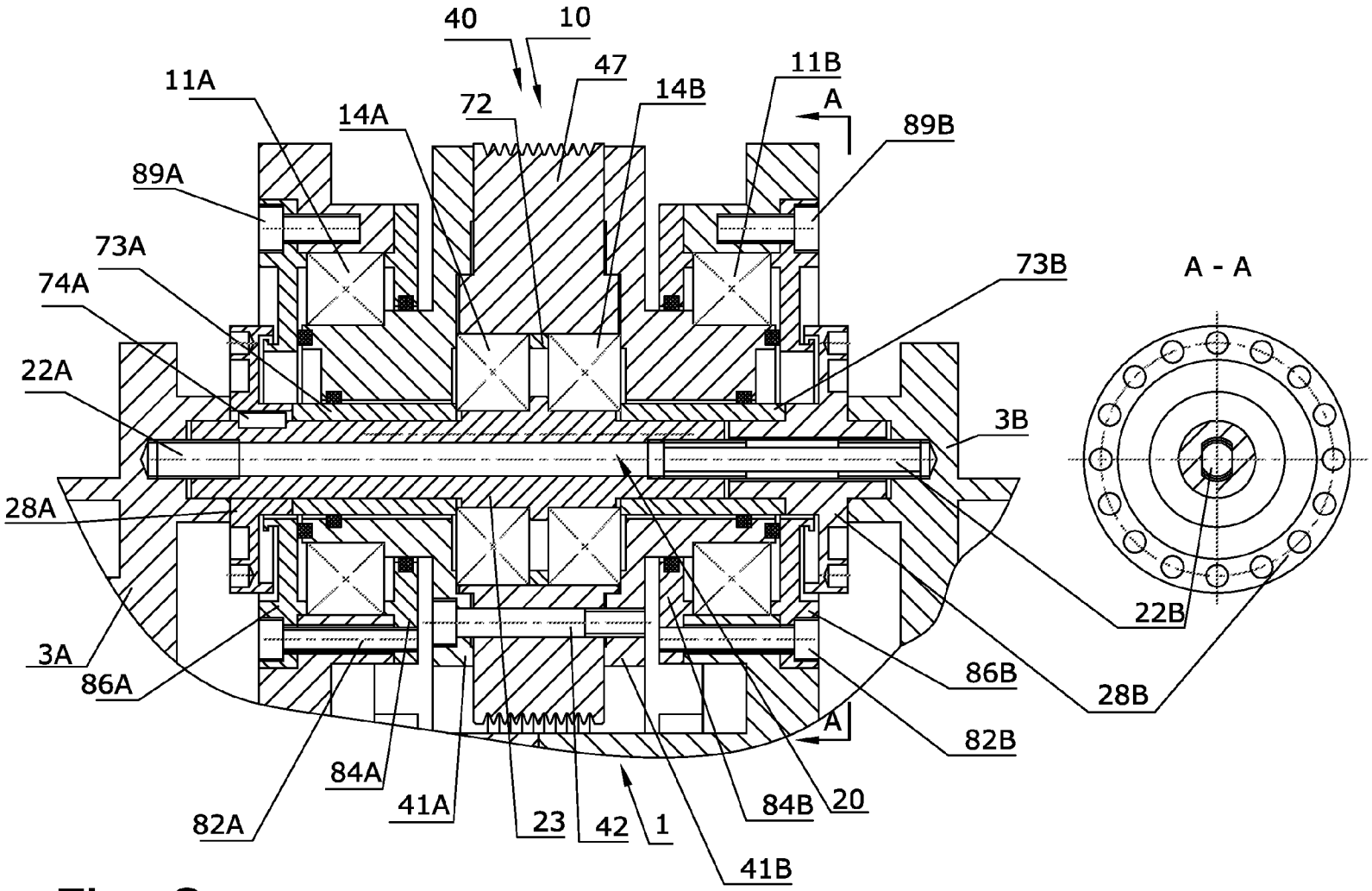
FIG. 8 is a schematic sectional view of an orbiting unit of the machinery according to embodiment 5 of the present invention.

As shown in FIG. 8, comparing with embodiment 4, the differences of this embodiment include that shaft 23 connects with orbiting scroll 3A through a regular screw rod 22A. Retaining ring 28A can rotate shaft 23 and screw rod 22A through key 74A to realize the assembling and disassembling of orbiting scroll 3A (Orbiting scroll 3A should be assembled first but disassembled last). Shaft 23 can be directly turned, and so key 74A and other constituent elements can be eliminated. Screw rod 22B (connector) is made to have two flat surfaces and opposite direction threads at its two ends. Turn retaining ring 28B (turning elements), which has a slot hole, can rotate the screw rod 22B to assemble or disassemble orbiting scroll 3B.

Embodiment 6

Figure 9:
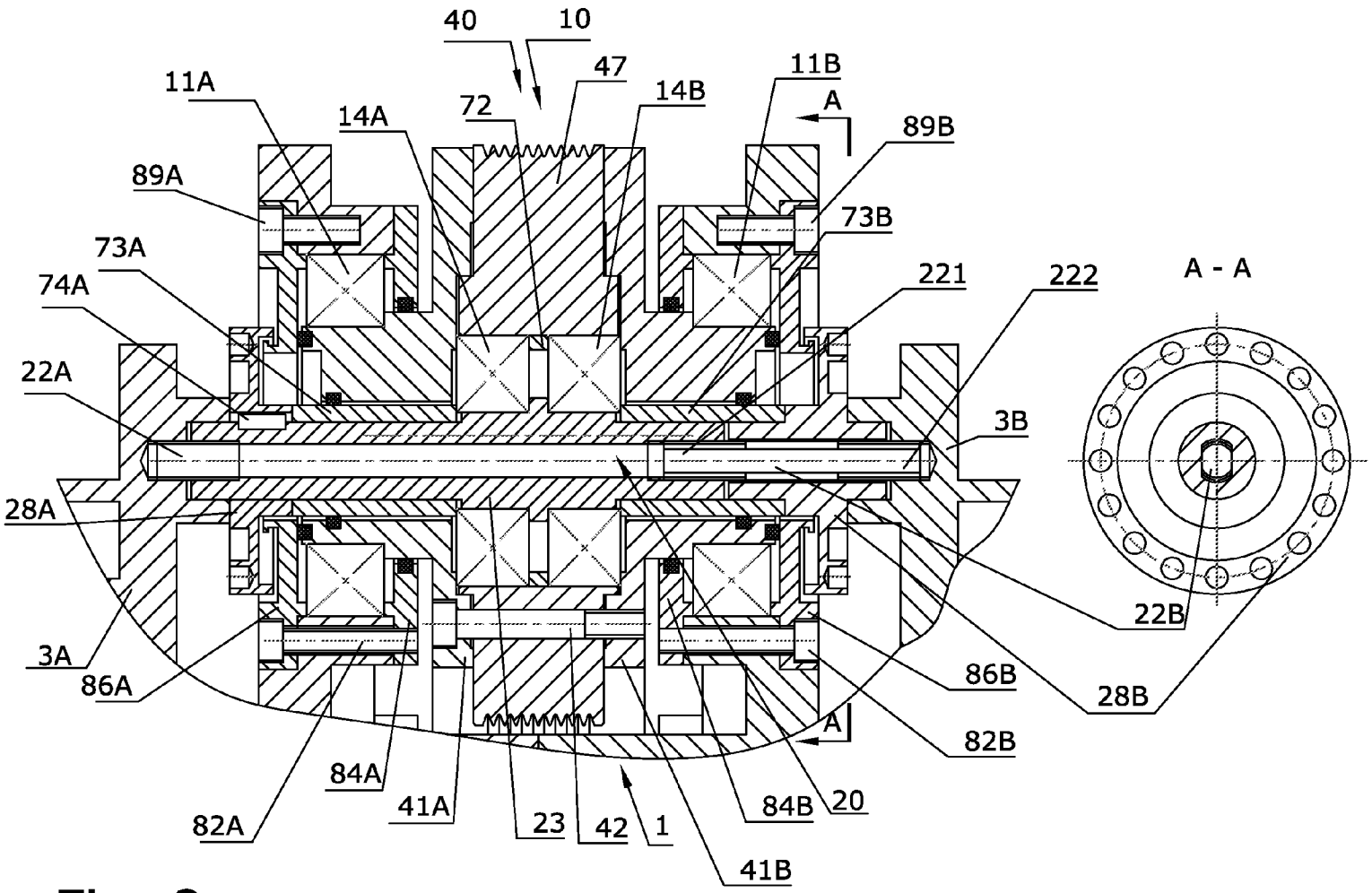
FIG. 9 is a schematic sectional view of an orbiting unit of the machinery according to embodiment 6 of the present invention.

As shown in FIG. 9, comparing with embodiment 5, the differences of this embodiment include that screw rod 22B (connector) has two flat surfaces and threads at its two ends with the same direction but different pitches. Thread 221 at the left end of screw rod 22B has smaller pitch than thread 222 at the right end. When assembling orbiting scroll 3B, screw rod 22B is put into shaft 23 first. Retaining ring 28B (turning element), which has a slot hole, can rotate screw rod 22B to assemble and disassemble orbiting scrolls 3B.

Embodiment 7

Water-Injection Oil-Free Scroll Air Compressors

In this embodiment, the same constituent elements as those in embodiment 1 are denoted by the same reference numerals, and a description thereof is omitted, except specific instructions.

As shown in FIGS. 10-14, comparing with embodiment 1, the current embodiment differs in that sleeve 71 replaces the shaft shoulder in middle of shaft 23 in embodiment 1. Shaft 23 functions as a connector, and fits in the inner rings of bearings 14A and 14B. It also can have small axial adjustment during assembly. The two ends of shaft 23 have internal threads with opposite directions, and connect with orbiting scrolls 3A, 3B through screw rods 22A and 22B separately. Retaining rings 28A and 28B (turning elements) constrain shaft 23 circumferentially through keys 74A and 74B, but not axially, and rotate shaft 23 directly to assemble and disassemble orbiting scrolls 3A and 3B through screw rods 22*a* and 22B. Shaft 23 and screw rods 22A and rod 22B can be integrated into a single connector with the two ends having opposite direction threads.

Figure 10:
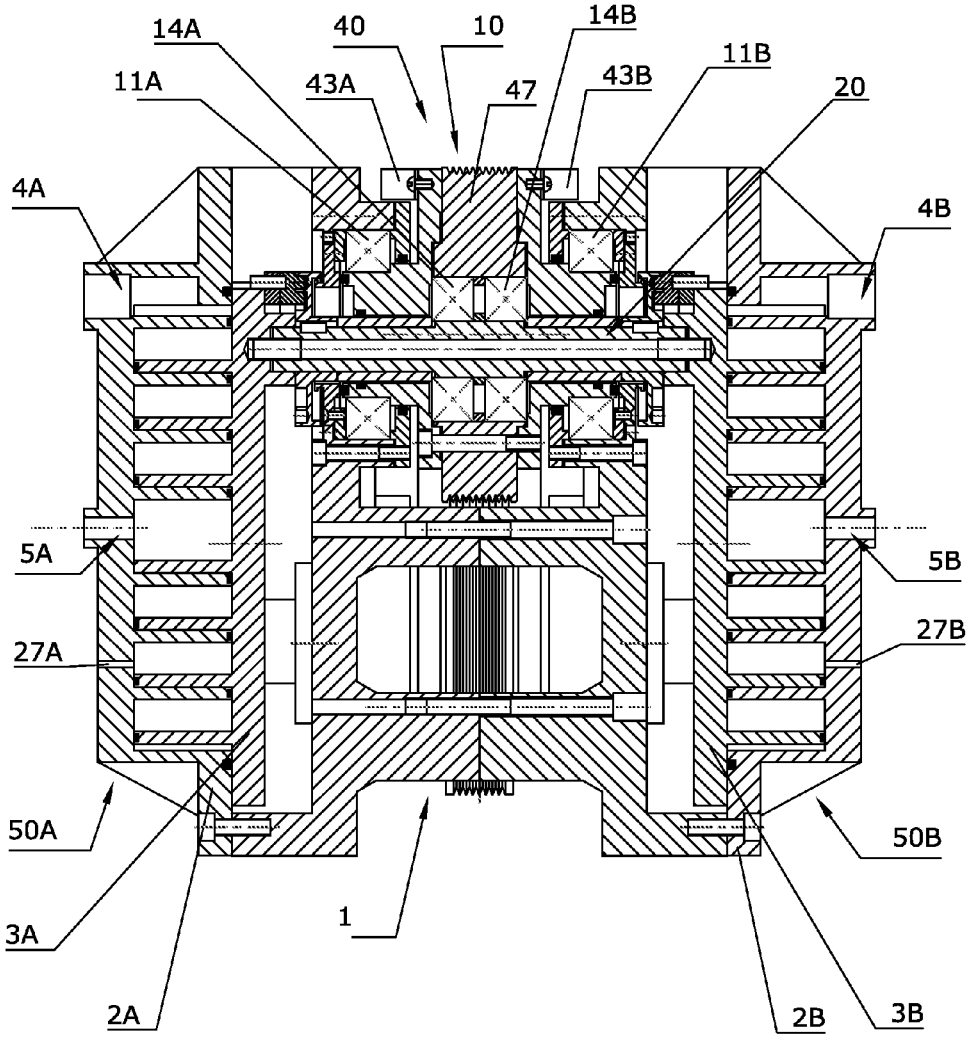
FIG. 10 is a schematic sectional view of a water-injection oil-free scroll air compressor according to embodiment 7 of the present invention.
Figure 11:
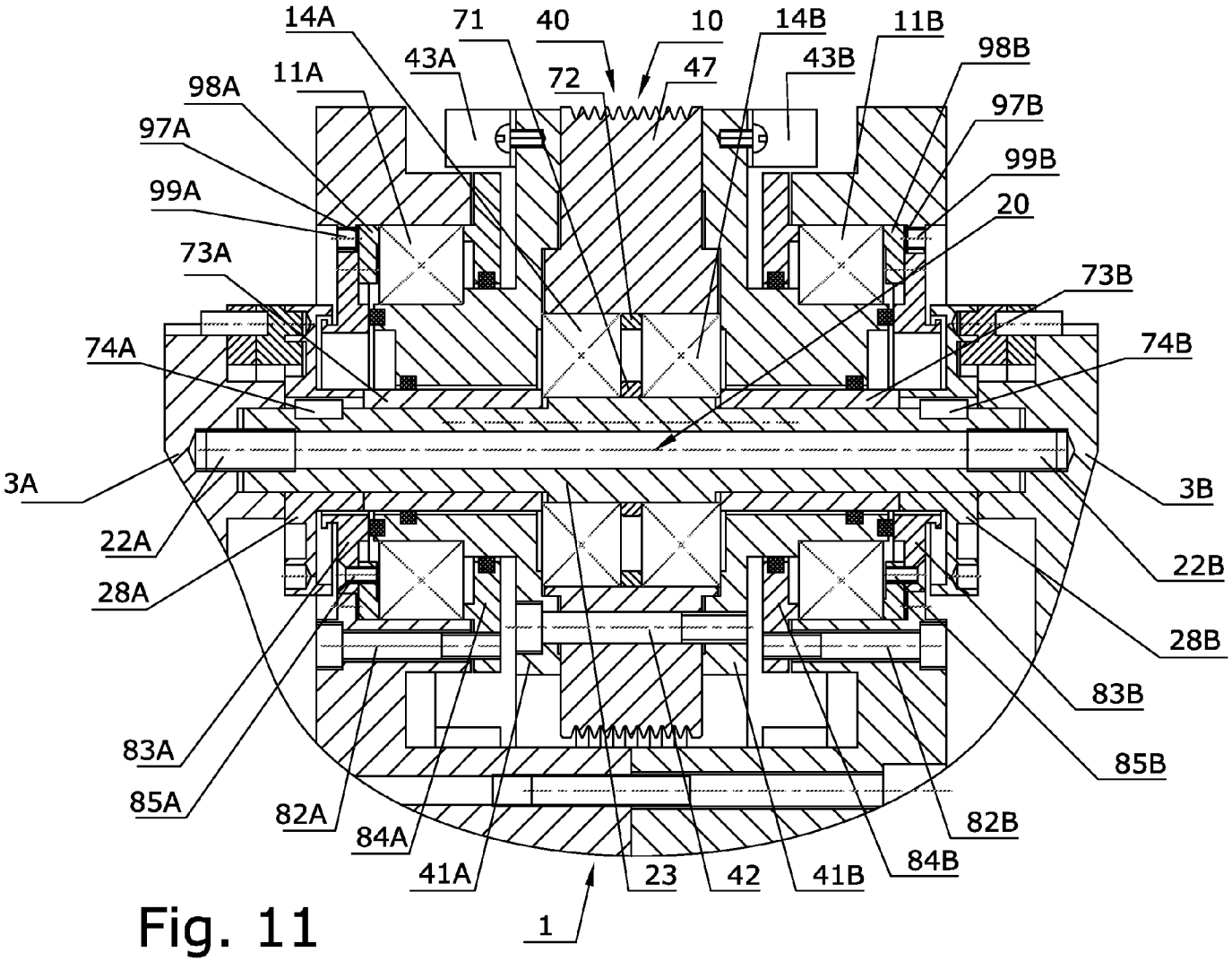
FIG. 11 is an enlarged schematic view of an orbiting unit of the machinery shown in FIG. 10.
Figure 13:
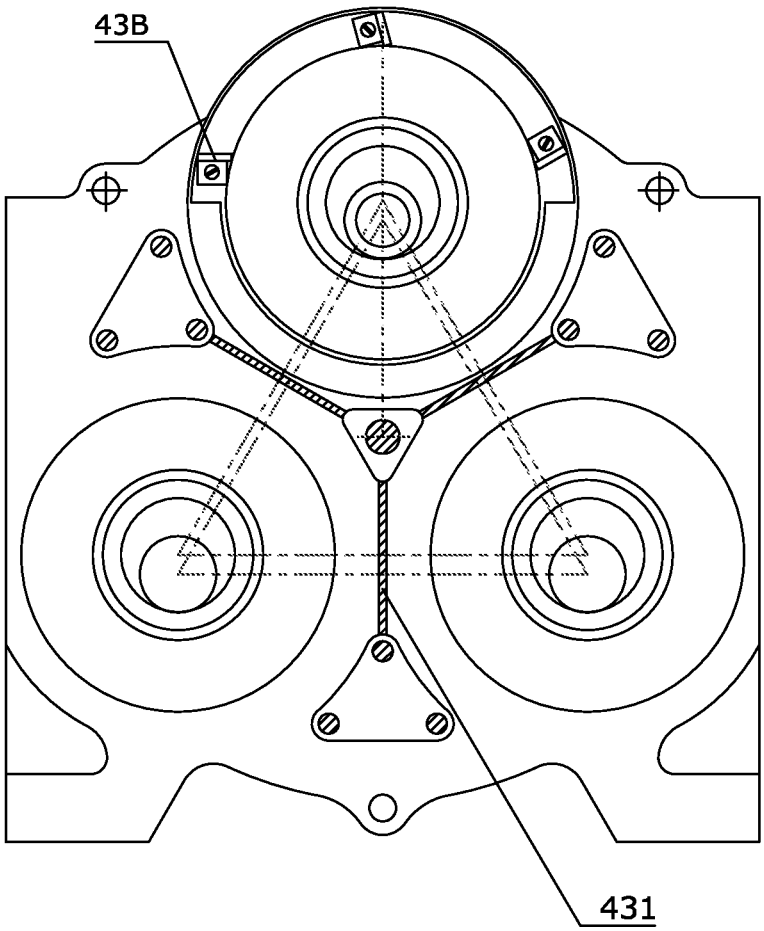
FIG. 13 is a layout view of cooling air ducts of the machinery shown in FIG. 10.

As shown in FIGS. 10, 11 and 13, rotating hubs 41A and 41B have blades 43A, 43B attached on their outer edges for ventilation and cooling purposes. Isolation plates 431 shown in FIG. 13 prevent the disturbance between the air flows generated by blades 43A (not shown in FIG. 13) and 43B of three rotating members 10 (only one shown in FIG. 13).

Figure 12:
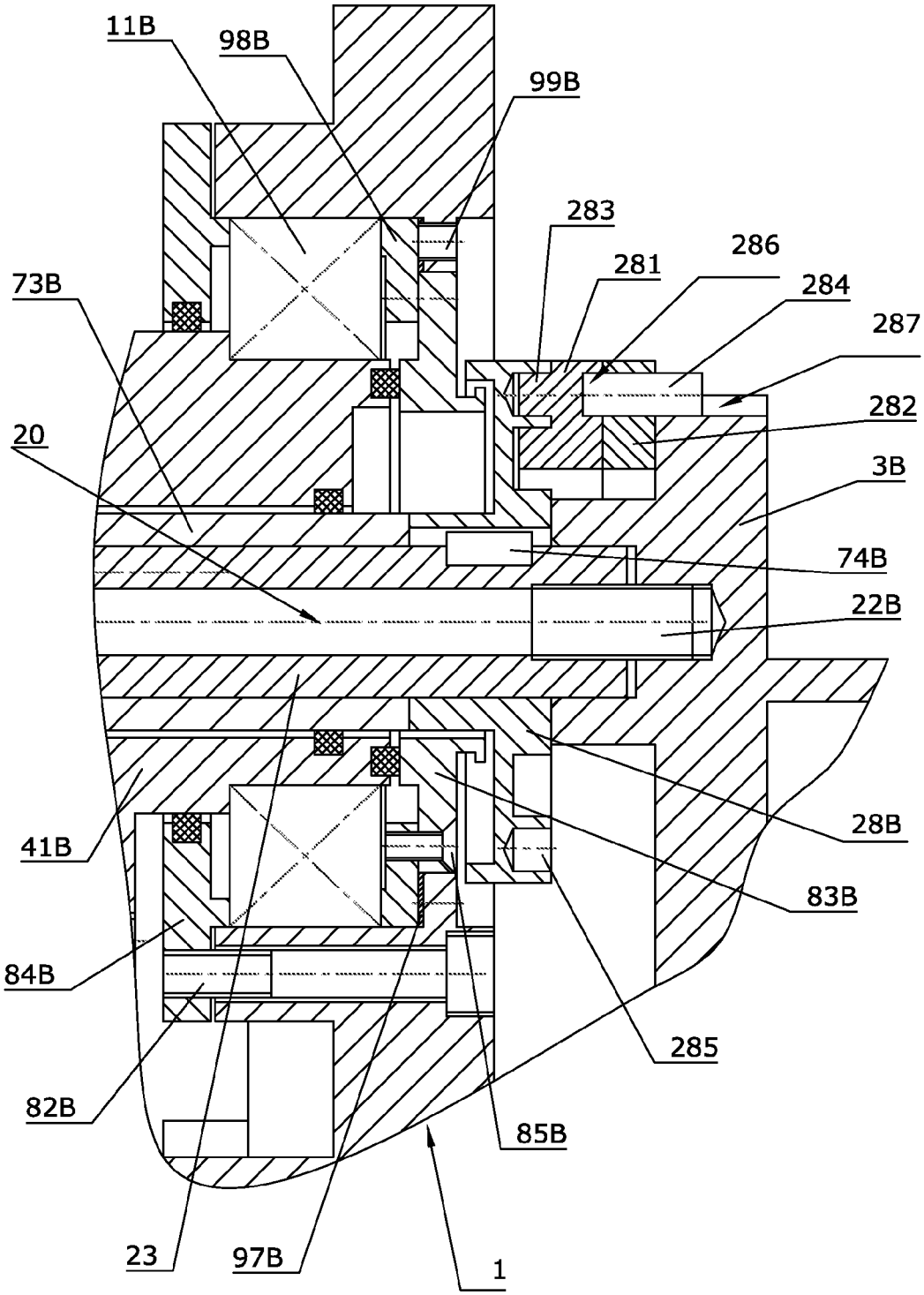
FIG. 12 is a further enlarged schematic view of the right portion of FIG. 11.

As shown in FIGS. 11 and 12, the axial clearance adjustment and preloading devices for bearings 11A and 11B differs from embodiment 1. Pressing rings 98A and 98B are located between housing 1 and bearings 11A and 11B; covers 83A and 83B are fixed onto pressing rings 98A and 98B through screw sets 85A and 85B. Screw sets 99A and 99B on housing 1 are, respectively, on the sides of pressing rings 98A and 98B to adjust the axial positions of the outer rings of bearings 11A and 11B, and achieve the desirable axial gaps between the bearings. Compensating shims 97A and 97B with appropriate thickness are put between housing 1 and pressing rings 98A and 98B, respectively, to fill the axial gaps and replace the screw sets 99A and 99B to withstand the thrust forces to housing 1 from bearings 11A and 11B. After the adjustment is completed, bolts 82A and 82B are tightened to maintain the preload. The axial clearance adjustment and preloading can also be achieved using only one side of the two devices described above, but using both makes it easier to adjust the axial position of rotating member 10.

Figure 14:
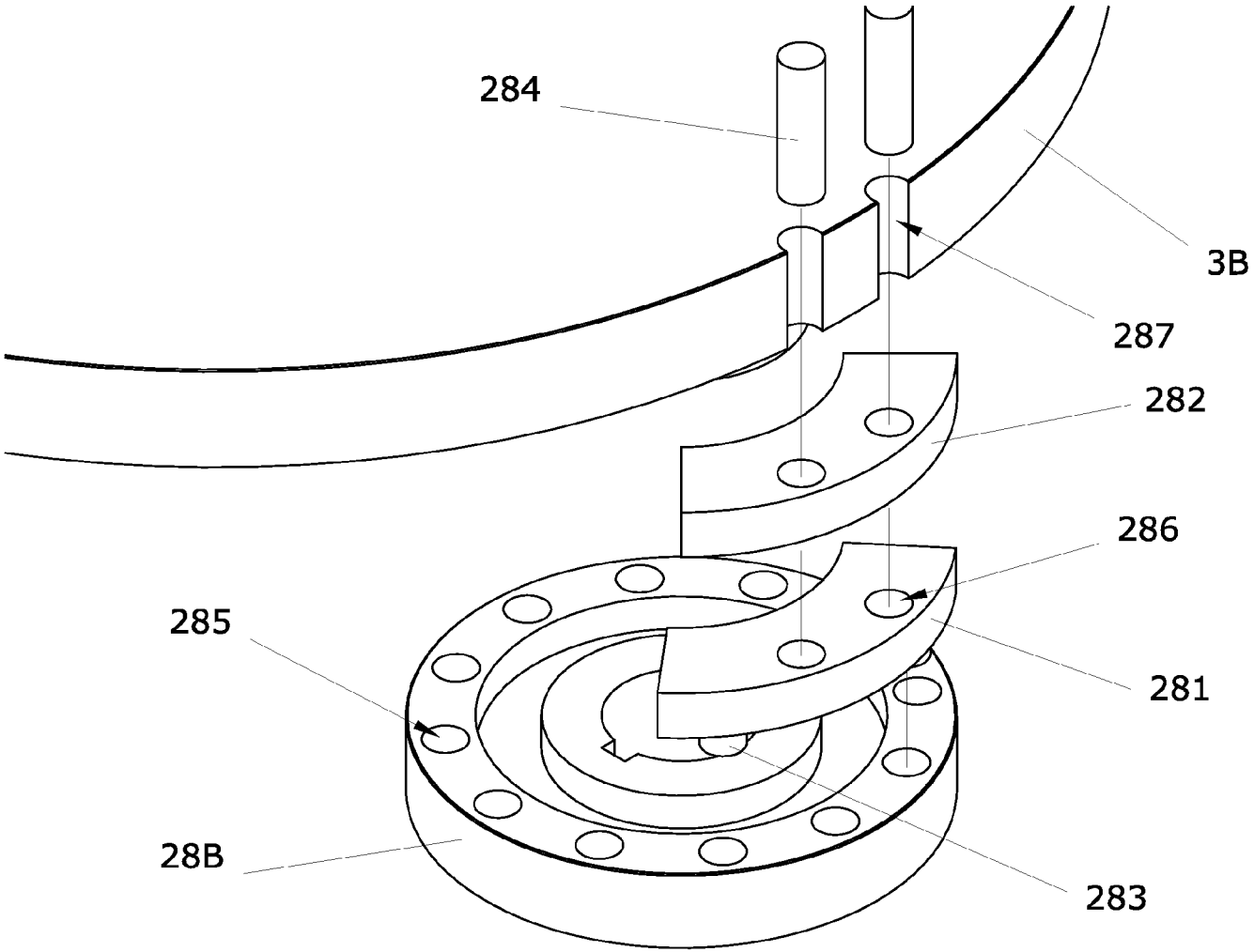
FIG. 14 is a view of a thread anti-loosening device of the machinery shown in FIG. 10.

As shown in FIGS. 12 and 14, an anti-thread-loosing device comprises locking blocks 281 and 282, and pin 284. On locking block 281 there are pins 283 fitting into the wrench holes 285 in retaining ring 28B. The holes in locking block 282 align with notches 287 on the outer edge of orbiting scroll 3B. Holes 286 are drilled to align with the holes in locking block 282 after retaining rings 28B is tightened, and then pins 284 are inserted into the holes.

Embodiment 8

Figure 15:
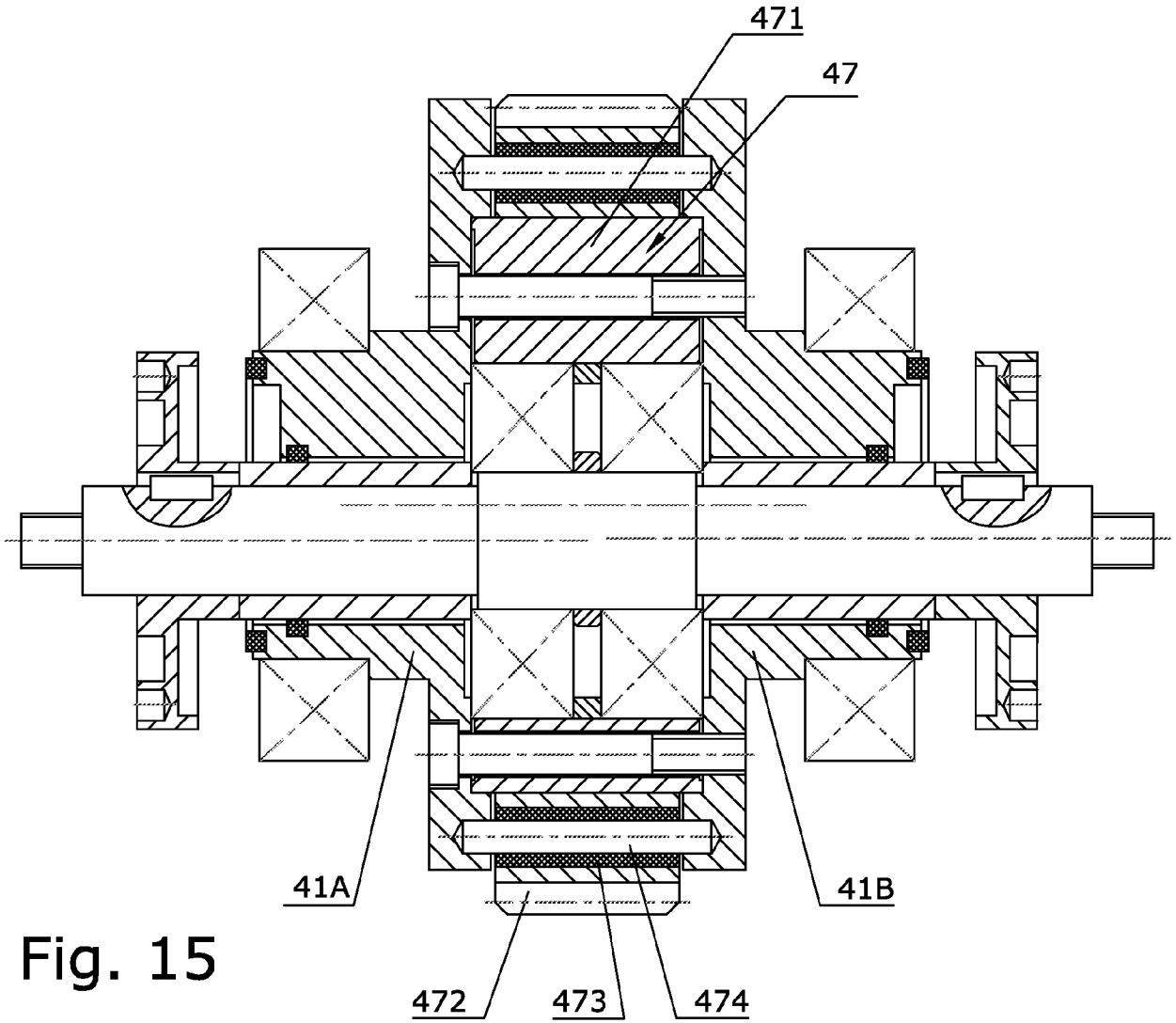
FIG. 15 is a schematic sectional view of an orbiting unit formed with a multi-piece assembled rotating member according to embodiment 8 of the present invention.

When the outer edge of the rotating member have the form of gears, sprockets, or synchronic pulleys, rotating ring 47 can be made of separate pieces. FIG. 15 is a schematic sectional view of an orbiting unit with a rotating ring made of separate pieces. Rotating ring 47 comprises an eccentric ring 471, which is assembled with rotating hubs 41A and 41B, a driving ring 472, which can be made to the form of gears, sprockets, synchronic pulleys, etc. Driving ring 472 is fitted on eccentric ring 471, and connects with rotating hubs 41A and 41B through elastic elements 473 and pins 474.

Figure 16:
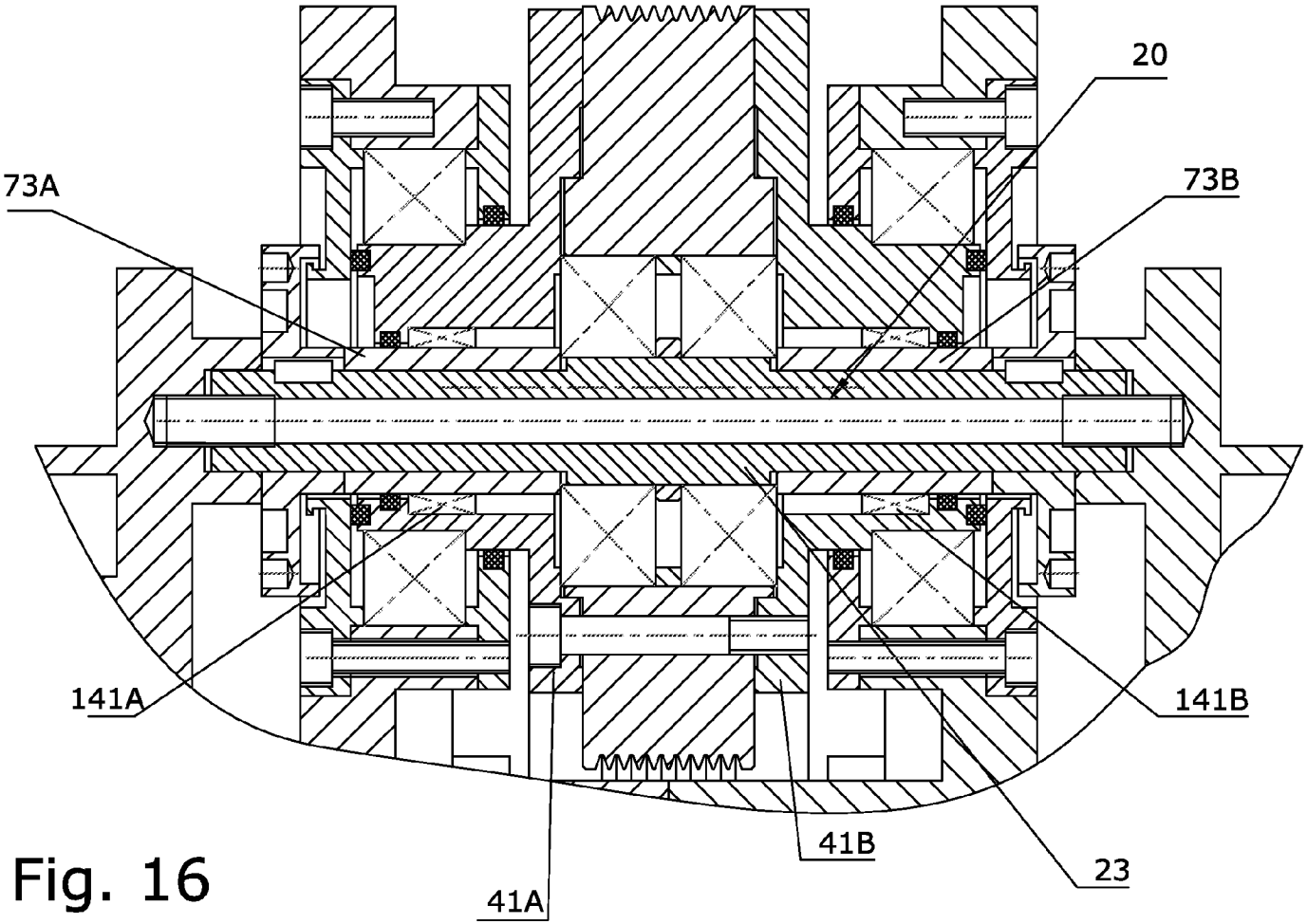
FIG. 16 is a schematic sectional view of the machinery shown in FIG. 10 with a bearing on a rotating hub.

When thrust-canceling shaft is long, a supporting bearing can be put between the thrust-canceling shaft and the rotating hub, as shown in FIG. 16. Rotating hubs 41A and 41B support sleeves 73A and 73B through bearings 141A and 141B, thus the bending stress in shaft 23 of thrust-canceling shaft 20 is reduced significantly. Bearings 141A and 141B can be pin bearings or sliding bearings, and the radial clearance should be slightly larger.

Embodiment 9

Water-Injection Oil-Free Scroll Air Compressors

Figure 17:
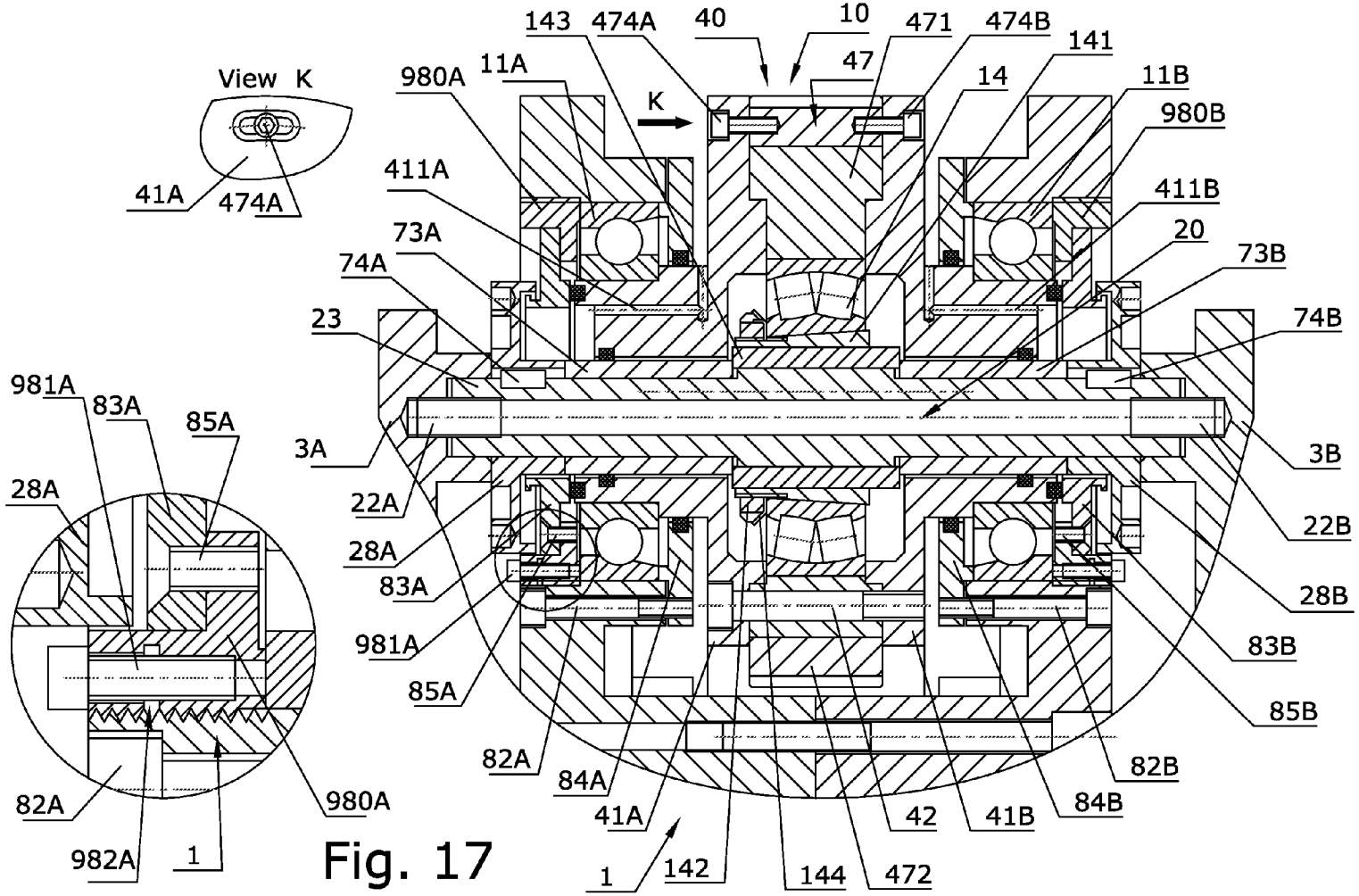
FIG. 17 is a schematic sectional view of an orbiting unit of a water-injection oil-free scroll air compressor according to embodiment 9 of the present invention.

In this embodiment, the same constituent elements as those in embodiment 7 are denoted by the same reference numerals, and a description thereof is omitted, except specific instructions. As shown in FIG. 17, wherein:

1. Rotating member 47 comprises eccentric ring 471 and driving ring 472, which can be made to the form of a synchronic pulley. When the rubber teeth of the synchronic belt has proper elasticity, rotating hubs 41A, 41B and driving ring 472 are connected rigidly with bolts 474A and 474B. Driving ring 472 can make angular adjustment to certain degree (as shown in View K of FIG. 18)
2. The supporting bearing group for thrust-canceling shaft 20 comprises a single bearing 14 which can be a spherical rotor bearing, self-aligning ball bearing or spherical bearing, and is assembled on sleeve 143 with certain pre-load through sleeve 141, locknut 142, and lockwasher 144.
3. Ducts 411A and 411B exist on the rotating hubs 41A and 41B to remove the water accumulated in cavities 412A and 412B.
4. Threaded adjusting ring 980A and 980B are used to adjust the axial clearance of bearings 11A and 11B and to apply appropriate pre-load, while locking screws 981A and 981B are used to lock adjusting rings 980A and 980B.

Figure 18:
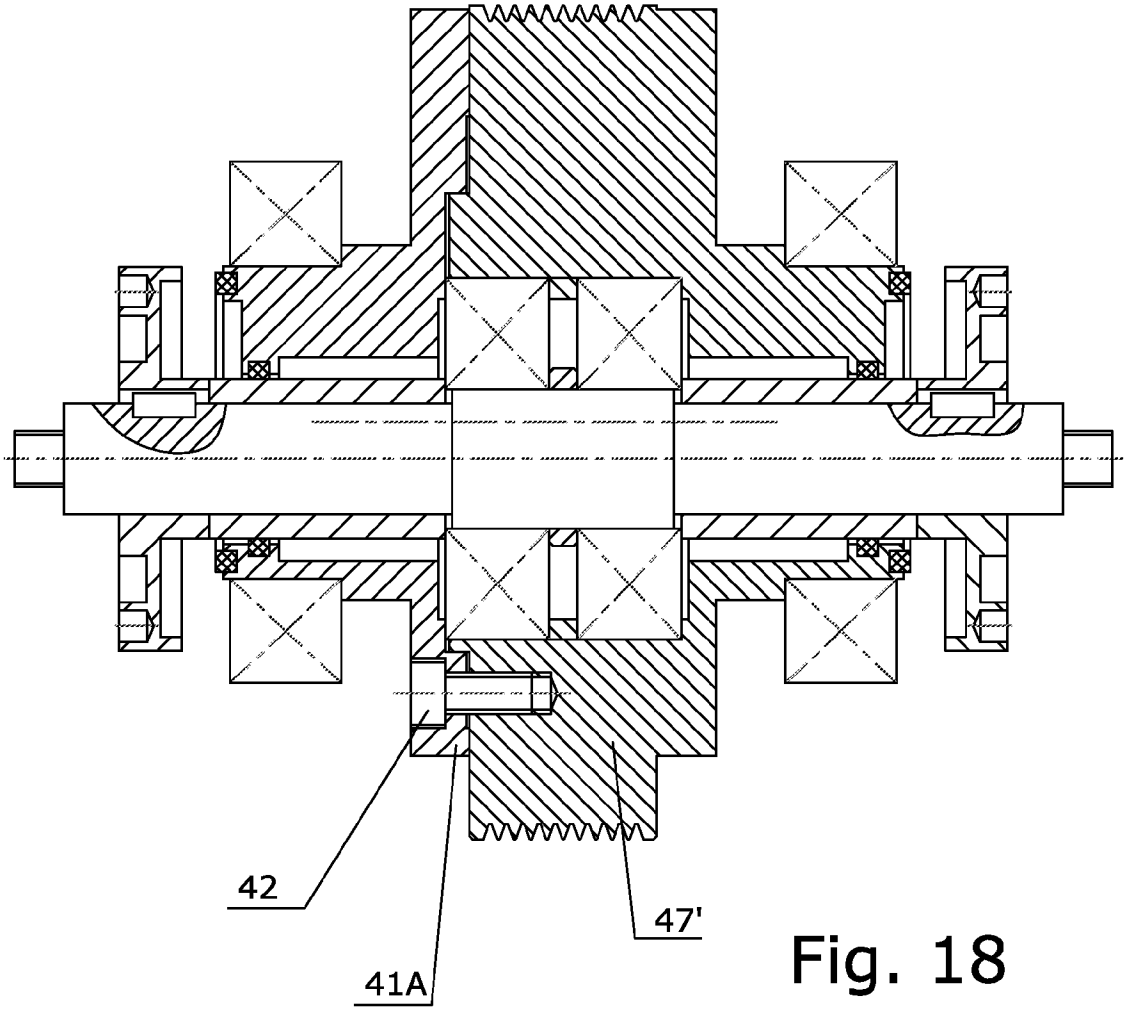
FIG. 18 is a schematic sectional view of an orbiting unit with rotating member and rotating hub integrated as one entity according to the present invention.

Although the assembled rotating member described in the above embodiments comprises a rotating member and two rotating hubs, the rotating member can be integrated with a rotating hub. As shown in FIG. 18, the integrated rotating member 47' and rotating hub 41A are assembled together by screw set 42 to form an assembled rotating member.

Figure 19C:
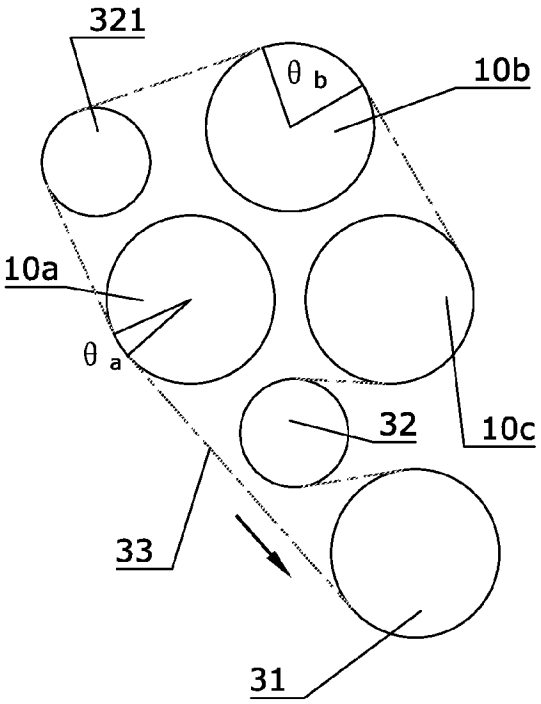
FIGS. 19A-19C are the schematic views of flexible DSPO driving mechanisms.
Figure 19B:
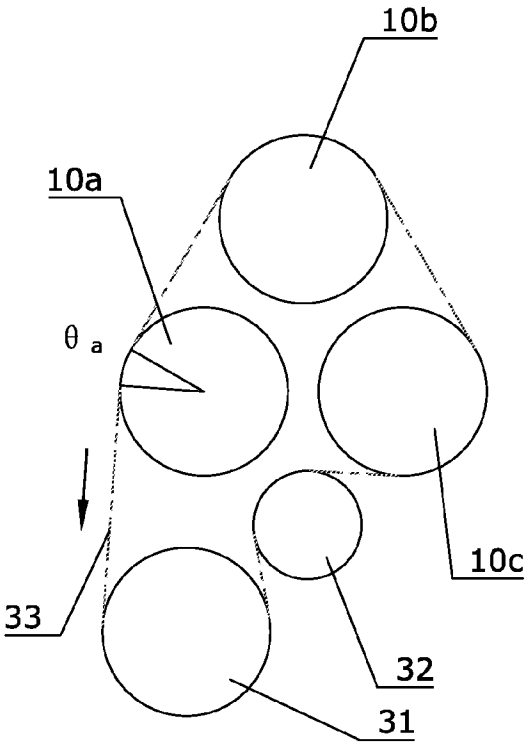
Figure 19A:
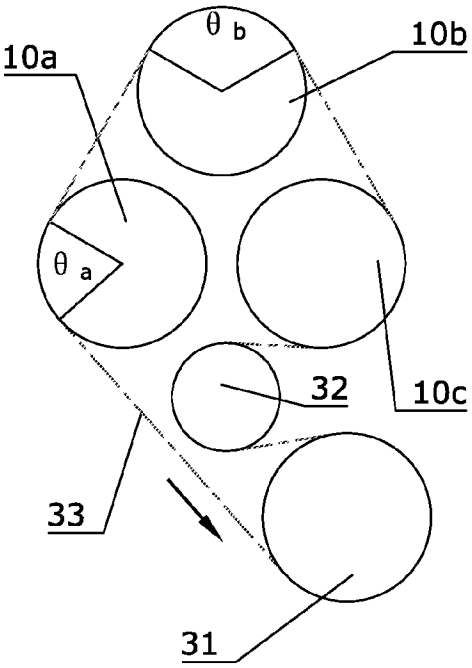

When the DSPO machinery described in the aforementioned embodiments is driven by a flexible element (such as a chain or a belt), it is very important for the loads on rotating members are balanced. FIGS. 19A, 19B, and 19C show DSPO machinery using flexible driving systems. Driving element 31 transmits the power to rotating members 10*a*, 10*b*, and 10*c* through flexible element 33 (as belt or chain). Tensioning device 32 is to tighten the flexible element 33. In general, when the wrapping angles of flexible element 33 on the rotating members are close enough, the load transmitted to rotating member 10*a* is the largest among the three rotating members, with rotating member 10*b* the next and rotating member 10*c* the smallest. The wrapping angles of flexible element 33 on rotating members 10*a* and 10*b* can be adjusted accordingly to even the load distribution. As shown in FIG. 19B, the position of driving element 31 is changed to reduce the wrapping angle, θa, of the flexible element 33 on rotating element 10*a*. An idler 321 can also be used to reduce the wrapping angles, θa, θb, of flexible element 33 on rotating element 10*a* and 10*b*, as shown in FIG. 19C. The method described above to balance the loads on the rotating members can be applied to other DSPO machinery.

Although in the foregoing embodiments, the present invention has been described using air scroll compressors as examples, the present invention is not limited to air scroll compressors, and it can be applied to other scroll type fluid machinery, such as vacuum pumps, refrigerant compressors and expanders, etc.

Although in the foregoing embodiments, the scroll type fluid machinery comprises two volume changing mechanisms having the same functions, the present invention is not limited to the described usages. For example, one of the two volume changing mechanisms can be used as a compression mechanism while the other used as an expansion mechanism.

Although a description for some common mechanical devices, such as balancer, tip seal, shaft seal, alignment pin, etc, is omitted in the foregoing embodiments, the present invention is not limited from their utilizations.

We claim:

1. A scroll type fluid machinery comprising:

a. a first volume changing mechanism comprising a first stationary scroll and a first orbiting scroll; a second volume changing mechanism comprising a second stationary scroll and a second orbiting scroll;

b. a housing connecting with said first and second stationary scrolls; and c. a plurality of orbiting units provided between said first and second volume changing mechanisms, with each said orbiting unit comprising:

a). a rotating member being rotatably supported on said housing; and b). a thrust-canceling shaft connecting with one end thereof to said first orbiting scroll and with the other end thereof to said second orbiting scroll, being eccentrically and rotatably supported in said rotating member, and comprising one or more assembly sets, with each comprising:

a] a connector connecting at least one of said first and second orbiting scrolls through threads; and b] one or more turning elements constraining said connector circumferentially while allowing said connector to move axially.

2. The scroll type fluid machinery according to claim 1, wherein said connector in said assembly set has two ends and comprises:

a thread on one end of the connector; or a thread at one of the two ends, and another thread at the other of the two ends, wherein the two threads have opposite directions; or a thread at one of the two ends, and another thread at the other of the two ends, wherein the two threads have the same direction but different pitches.

3. The scroll type fluid machinery according to claim 2, wherein said thrust-canceling shaft is supported by said rotating member through a second bearing group; said rotating member is supported by said housing through a first bearing group, and comprises:

a. a rotator with an eccentric hole holding said second bearing group;

b. a first rotating hub and a second rotating hub assembled with said rotator and said first bearing group.

4. The scroll type fluid machinery according to claim 3, wherein said rotator and said first or second rotating hub are formed together as one body.

5. The scroll type fluid machinery according to claim 3, wherein said rotator comprises:

a. an eccentric ring connecting said first and second rotating hubs; and b. a driving ring being able to move circumferentially with respect to said eccentric ring, and having elastic circumferential connection with said first and second rotating hubs.

6. The scroll type fluid machinery according to claim 1, wherein said connectors in said assembly sets contact the inner ring of said second bearing group and provides radial support to said second bearing group.

7. The scroll type fluid machinery according to claim 1, wherein said rotating member has an air duct for cooling.

8. The scroll type fluid machinery according to claim 1, wherein water cooling ducts exist on said housing near said first bearing group.

9. The scroll type fluid machinery according to claim 1, wherein ducts exist in said rotating members for draining fluid.

10. The scroll type fluid machinery according to claim 3, wherein cooling blades exist on said rotating members; there further exist diaphragms attached on said housing to prevent air disturbance caused by said blades.

11. The scroll type fluid machinery according to claim 1, wherein first bearing group comprises:

a. a first bearing and a second bearing;

b. one or more axial clearance adjustment devices.

12. The scroll type fluid machinery according to claim 11, wherein said axial clearance adjustment device comprises:

a. a pressing ring located between said housing and said first or second bearings;

b. adjusting screw sets used to adjust the axial position of the outer ring of said first or second bearings.

13. The scroll type fluid machinery according to claim 11, wherein said axial clearance adjustment device comprises threaded adjusting rings and locking devices.

14. The scroll type fluid machinery according to claim 3, wherein a third bearing group is located between said thrust-canceling shaft and said first and second rotating hubs to reduce the bending stress on said thrust-canceling shaft.

15. The scroll type fluid machinery according to claim 3, wherein said second bearing group comprises one bearing.

16. The scroll type fluid machinery according to claim 15, wherein said one bearing is a spherical rotor bearing, a self-aligning ball bearing, or a spherical bearing.

17. The scroll type fluid machinery according to claim 1, wherein a driving element transmits power to said rotating members through a flexible element.

18. A method of assembling and disassembling the orbiting scrolls of a scroll type fluid machinery, said scroll type fluid machinery comprises:

a. a first stationary scroll and a first orbiting scroll;

b. a second stationary scroll and a second orbiting scroll;

c. a housing; and d. a plurality of orbiting units, each of said orbiting units comprising:

a). a rotating member; and b). a thrust-canceling shaft comprising one or more assembly sets, with each comprising:

a] a connector connecting at least one of said first and second orbiting scrolls through threads; and b] one or more turning elements constraining said connector circumferentially while allowing said connector to move axially;

said method comprises rotating said turning elements of said assembly sets to turn said connector accordingly and thus to move the at least one of said first and second orbiting scrolls through said threads.

* * * * *